US006129530A

United States Patent [19]

Shaffer

[11] Patent Number: 6,129,530

[45] Date of Patent: Oct. 10, 2000

[54] SCROLL COMPRESSOR WITH A TWO-PIECE IDLER SHAFT AND TWO PIECE SCROLL PLATES

[75] Inventor: Robert W. Shaffer, Hamilton, Ohio

[73] Assignee: Air Squared, Inc., Hamilton, Ohio

[21] Appl. No.: 09/161,629

[22] Filed: Sep. 28, 1998

[51] Int. Cl.[7] ..... F04C 18/00

[52] U.S. Cl. ..... 418/55.1; 418/55.2; 418/55.3; 418/55.4; 29/156.4

[58] Field of Search ..... 418/55.1, 55.3, 418/55.2, 55.4; 29/156.4

[56] References Cited

U.S. PATENT DOCUMENTS

| | | | |
|---|---|---|---|
| 4,436,495 | 3/1984 | McCullough . | |
| 4,462,771 | 7/1984 | Teegarden | 418/55.1 |
| 4,726,100 | 2/1988 | Etemad et al. | 29/156.4 |
| 4,730,375 | 3/1988 | Nakamura et al. | 29/156.4 |
| 4,875,839 | 10/1989 | Sakata et al. | 418/55.1 |
| 5,044,904 | 9/1991 | Richardson, Jr. . | |
| 5,051,079 | 9/1991 | Richardson, Jr. . | |
| 5,466,134 | 11/1995 | Shaffer et al. . | |
| 5,632,612 | 5/1997 | Shaffer . | |
| 5,752,816 | 5/1998 | Shaffer . | |
| 5,759,020 | 6/1998 | Shaffer . | |

*Primary Examiner*—Thomas Denion
*Assistant Examiner*—Thai-Ba Trieu
*Attorney, Agent, or Firm*—Paul M. Denk

[57] ABSTRACT

A scroll compressor is provided with idler shafts and scroll assemblies, both of which are two-piece assemblies. The two pieces of the idler shaft are made independently of each other and each includes an axis of symmetry which facilitates forming, or partial forming, of the parts on a lathe. The two parts, each of which includes a shaft, are then joined together with the shafts offset from each other to form the proper eccentricity in the idler shaft. The scroll assemblies are made by first forming a base plate for the desired scroll and then forming an eccentric groove in the base plate. An involute, which is formed to correspond to the groove is inserted in the base plate groove. The involute has grooves on both of its end surfaces to allow the same involute to be used for both the fixed and orbiting scroll plate.

7 Claims, 3 Drawing Sheets

SCROLL COMPRESSOR WITH A TWO-PIECE IDLER SHAFT AND TWO PIECE SCROLL PLATES

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This application relates to scroll compressors, and in particular, to an improved idler shaft and an improved involute for use with such compressors which can reduce the expense and time involved in manufacturing the components of scroll compressors.

As is generally known, scroll compressors include a fixed scroll and an orbiting scroll, both of which contain an involute. The involutes of the fixed and orbiting scrolls intermesh, and the orbiting scroll revolves eccentrically relative to the fixed scroll, to compress air contained between the involutes of the two scrolls.

Idler shafts maintain proper orientation and alignment of the orbiting scroll relative to the fixed scroll, as well as support the thrust load of the orbiting scroll. The idler shafts also determine the orbiting radius of the orbiting scroll so that the orbiting scroll involute does not interfere with the fixed scroll involute. Because of the close tolerances which must be obtained in the operation of the scroll compressor, the idler shaft must be machined or otherwise formed to within very close tolerances.

Generally, idler shafts are made from a single piece of bar, or are cast to near net shape. They are then precision ground to maintain the critical eccentric. The grinding process is thus very expensive and very time consuming.

Similarly, the manufacture of the scroll members (i.e., the fixed and orbiting scrolls) is very expensive. Generally, the scroll members are made from a single piece of cast or bar material. The involute shape is then machined into the scroll base. To achieve a properly formed involute typically requires 6 to 8 passes. This requires specialized machining centers that are capital intensive. This makes the scroll manufacturing very expensive.

BRIEF SUMMARY OF THE INVENTION

A scroll compressor includes idler shafts and scroll assemblies, both of which are two-piece assemblies. The idler shafts and scroll assemblies, when made according to the present invention, reduce the cost and time involved in making these components, and hence the time involved in producing the components.

The idler shafts include a first part and a second part. The first part is a one-piece unitary part having an axis of symmetry and including a base, a stem, and a shaft extending up from the stem. The second part includes a shaft or stem, and is secured to the first part so that the second part shaft is offset from the first part shaft. This offset will produce the desired eccentricity. In one embodiment, the first and second parts are identical, and the second part also includes a base, a stem, and a shaft. The base of the second part is fixed to the base of the first part so that the stems of the two parts extend in opposite directions. The two parts can be fixed together by brazing or welding, for example.

In a second embodiment, the first part of the idler shaft includes a threaded bore formed in an end surface of the base on a side of the base opposite the stem. The second part also includes a base and a stem. The second part further includes a bore which extends through the center of the base and the stem. A bolt is passed through the bore of the second part and is threaded into the bore of the first part to secure the first and second parts together.

In a third embodiment, the first part includes a bore in an end surface of the base opposite the stem of the first part. The second part comprises a rod which is fixed in the bore of the first part to extend away from the first part stem. The bore in the first part can be a smooth bore, and the rod can be a dowel rod, for example, which is simply pressed into the bore. Alternatively, the bore can be threaded, and the rod can be threaded to be screwed into the bore of the first part.

In all three embodiments, the two parts are formed independently of each other and have an axis of symmetry, enabling the parts to be easily formed or finished, for example, on a lathe. The two parts are then joined together, with the shaft or stem of the first part being offset from the shaft or stem of the second part to produce the desired eccentricity.

The scroll plate utilizes an involute which is used to form both the fixed scroll and the orbiting scroll. The scroll plate assembly is formed by forming the scroll plate base and then securing the involute to the base. The base is formed, for example by casting, and an involute groove is formed in the base. The involute is formed to the desired shape with a groove in both of its opposed end surfaces. The shape of the involute (in plan) corresponds to the shape of the groove formed in the scroll plate base. The involute is fixed in the groove in the plate, and an elastomeric tip-seal is placed in the groove of the exposed end of the involute.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
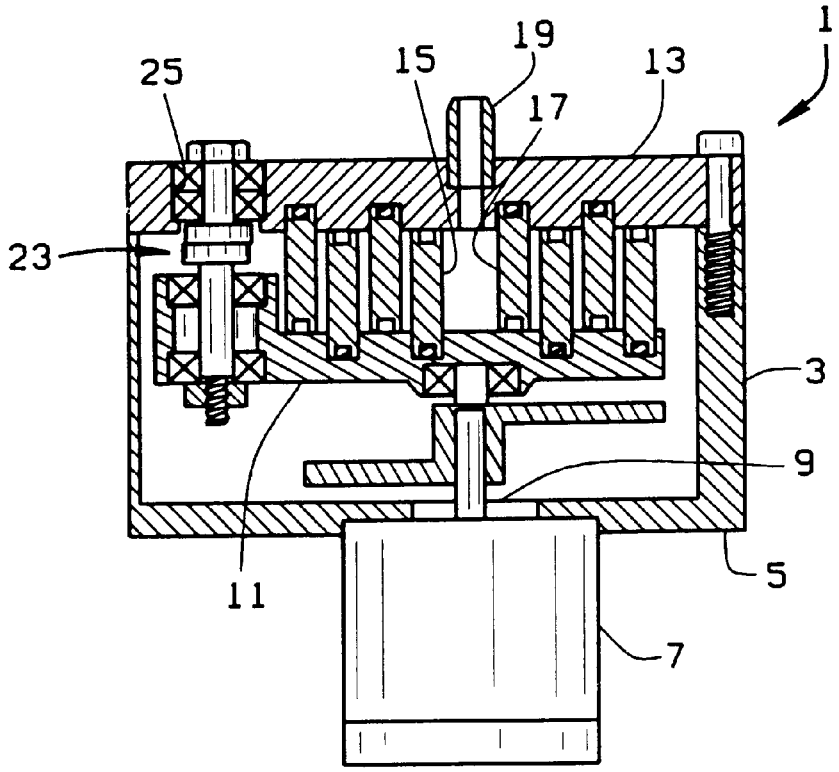
FIG. 1 is a cross-sectional view of a scroll compressor.

A scroll compressor 1 is shown in FIG. 1. The scroll compressor includes a housing 3 having an end plate 5. A motor 7 is mounted to the end plate 5 and its output shaft 9 extends into the housing through an opening in the end plate 5. An orbiting scroll plate 11 is mounted to the end of the motor's output shaft. A fixed scroll plate 13 is mounted to the top of the housing. As is known, the orbiting scroll plate 11 is moved in an eccentric path relative to the fixed scroll plate 13. Involutes 15 and 17 of the orbiting and fixed scroll plates, respectively, define chambers of ever decreasing size between the scroll plates, and, as gas is forced through the chambers, the gas is compressed. The compressed gas then exits through the outlet 19 in the center of the fixed scroll plate 13.

Figure 2:
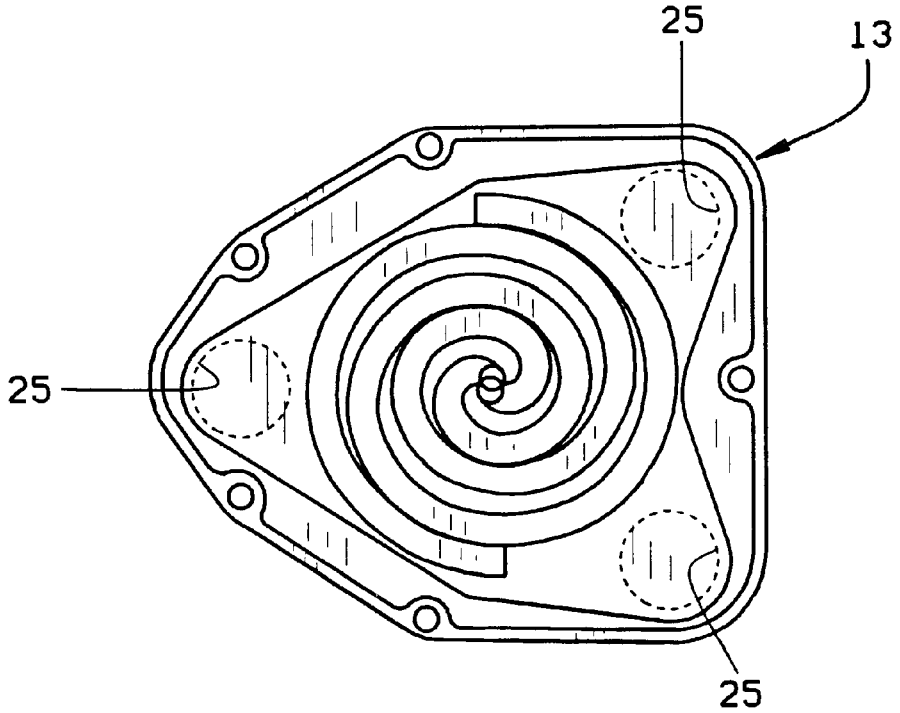
FIG. 2 is a top plan view of a scroll member base.

The fixed and orbiting scroll plates 11 and 13 are interconnected through idler shafts 23 which define the eccentric path followed by the orbiting scroll plate 11. As seen in FIG. 2, the scroll plates have three openings 25 which receive idler shafts. The idler shafts 23 include one shaft which is received in the fixed scroll plate and a second shaft which is received in the orbiting scroll plate. The two shafts are offset from each other and extend in opposite directions from a base. Typically, as noted above, the complete idler shaft is formed from a single piece of bar stock or is otherwise formed as a single piece. To prevent the involutes from the fixed and orbiting scroll plates from colliding, the idler shafts must be formed to within very close tolerances. The offset of the two shafts of the idler shaft make machining of the idler shaft difficult and expensive.

Figure 3:
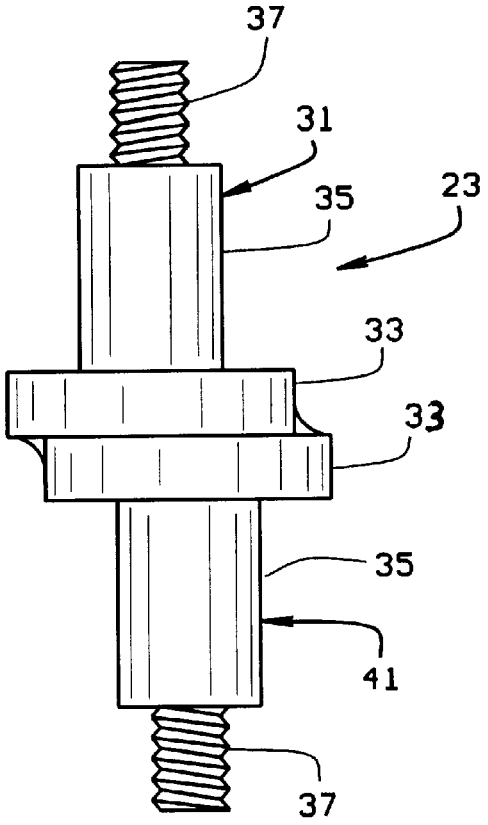
FIG. 3 is a side elevational view of a two piece idler shaft for use with the scroll compressor.

A first embodiment of an idler shaft 23 of the present invention is shown in FIG. 3. The idler shaft 23 is a two piece idler shaft made from two parts 31 and 41. Each part 31 includes a base 33, a stem 35 extending from the base, and a threaded shaft 37 extending from the stem 25. The base, stem, and shaft are preferably circular in plan, and coaxial with each other. The two halves, as noted, are identical. Each is symmetric about an axis through the center of the base, stem, and threaded shaft. The idler shaft halves can therefore be very easily and inexpensively machined from bar stock on a lathe. The halves can also be formed by screw machining. Alternatively, the halves can be cast or molded to shape or to near-net shape, and then refined with final turning. Because the eccentric need not be machined in, the two halves can be formed to very close tolerances simply and easily.

Once the two halves are formed, the two halves are joined together at their bases. To form the proper eccentric of the desired idler shaft, the two halves are off-set from each other, as seen in FIG. 3. The two halves may be welded or brazed together, as shown in FIG. 3, or connected by other conventional means, such as bolts, rods, etc. The use of two independent halves, which are joined together, also reduces the amount of idler shaft inventory necessary. Because the halves are not machined for a specific compressor, the relative position of the two halves can be set as desired. Thus, the amount of eccentric which can be built into the idler shaft 23 is limited by the size of the base. The two halves can be secured together so that the shafts are closer together or farther apart.

Figure 4:
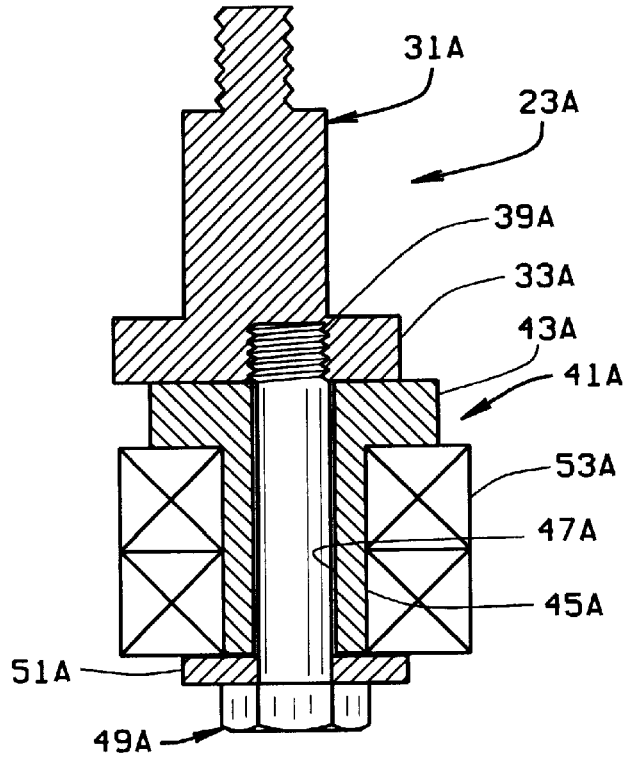
FIG. 4 is a second embodiment of the idler shaft.

A second embodiment of the idler shaft is shown in FIG. 4. The idler shaft 23A of FIG. 4 includes a first half 31A substantially identical to the part 31 of the idler shaft 23 of FIG. 3. However, the half 31A includes a threaded hole 39A formed in its base 33A. The threaded hole 33A is offset from the axis of the part 31A. As can be appreciated, the eccentric of the idler shaft 23A can be set as desired by the selective placement of the hole 39A. The second half 41A of the idler shaft 23A includes a base 43A and a stem 45A. A passage or bore 47A extends through the stem and base of the half 41A. The bore 47A is coaxial or centered with respect to the stem and base. A bolt 49A is passed through the bore 47A and its threaded end is screwed into the hole 39A in the base 33A of the first part 31A. The bolt 49A will thus hold the two halves 31A and 41A together. A washer 51A, having an outer diameter larger than the diameter of the stem 45A is positioned between the head of the bolt 49A and the end of the stem 45A. Bearings 53A may be positioned between the washer 51A and the base 43A of the second half 41A. The bearings are sized to be received in the openings 25 in the scroll plates. Bearings can be placed about the stem of the first part 31A.

Figure 5:
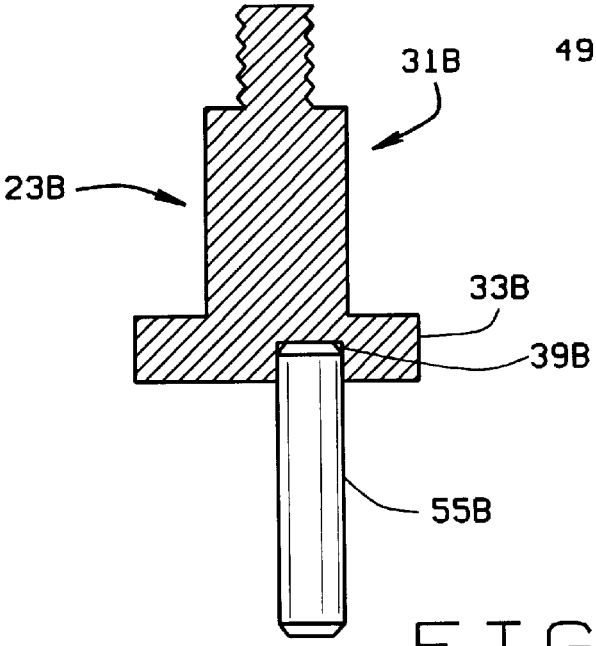
FIG. 5 is a third embodiment of the idler shaft.

A third embodiment of the idler shaft is shown in FIG. 5. The idler shaft 23B includes a first part 31B substantially similar to the part 31 or 31A of FIGS. 3 and 4. However, the part 3lB includes a bore 39B in its base 33B. The bore 39B is offset from the axis of the part 31B. A shaft or dowel rod 55B is press fit in the bore 39B.

As can be appreciated, the parts of the idler shafts 23, 23A, and 23B are made of parts which have an axis of symmetry, and can thus be machined to close tolerances. The placement of the bores 39A and 39B of the idler shafts 23A and 23B, respectively, also can be precisely located and formed. Thus, the idler shafts of the present invention can be formed accurately and at much less cost than forming one-piece idler shafts into which the eccentric has to be machined. Further, as noted above, if the bores in the first parts 23A and 23B are formed prior to assembling the idler shafts, the number of parts required to be kept in inventory will be much less than if the bores are pre-formed. The bores can be formed in the parts as needed, to produce the eccentricity needed in the specific idler shaft for a specific compressor. Again, as with the embodiment of FIG. 3, the amount of eccentricity which can be formed in the idler shafts of FIGS. 4 and 5 is limited only by the size of the bases 33A and 33B.

Figure 6:
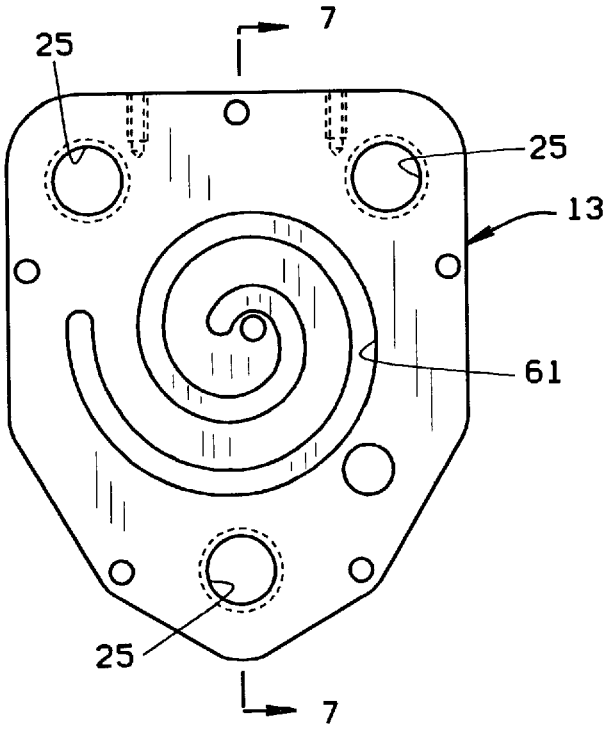
FIG. 6 is a plan view of a scroll compressor base member.
Figure 7:
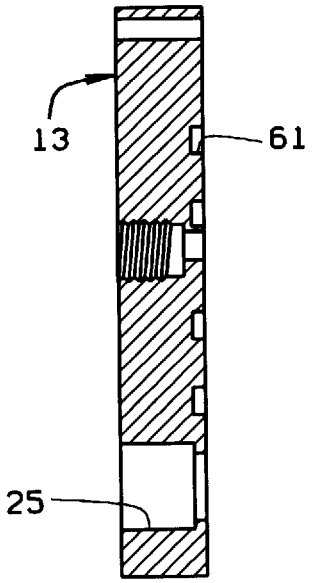
FIG. 7 is a cross-sectional view of the base member.
Figure 8:
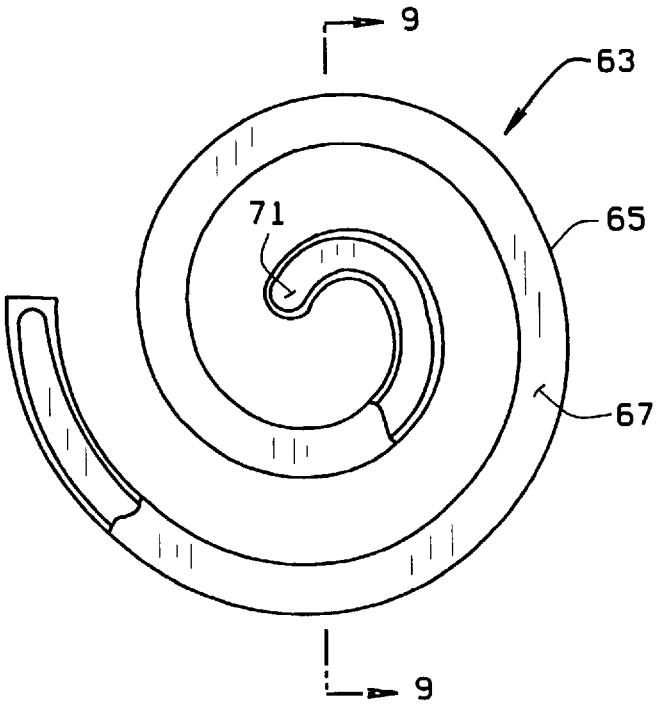
FIG. 8 is a top plan view, partially cut away, of an involute for use with the scroll compressor.
Figure 9:
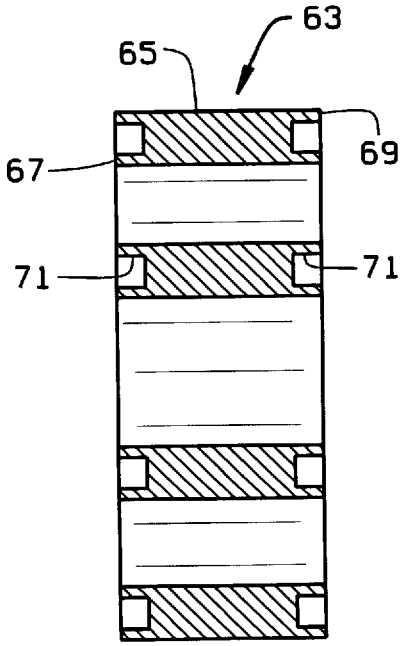
FIG. 9 of a cross-sectional view of the involute.

The scroll plates for both the fixed and orbiting scrolls are made of two pieces, a scroll plate base and an involute. The involute and scroll plates are shown in FIGS. 6–9. In producing the scroll, the scroll plates (the fixed plate 13 is shown in FIGS. 6 and 7) are fabricated from a flat plate or a casting. The base of the plate is machined flat if necessary and a shallow involute groove 61 is machined into the base.

An involute 63 is made to net shape without any machining. The involute can be made, for example, by injection molding, compression molding, powder metallurgy, or die casting. The involute 63 includes an involute wall 65 having opposed upper and lower edges or surfaces 67 and 69. A tip seal groove 71 is molded or otherwise formed in both edges 67 and 69 of the involute. This allows for the same involute 63 to be used with either the base of the fixed scroll or the orbiting scroll.

To form the scroll plates, a scroll base (either a fixed or orbiting scroll base is selected) and the involute 63 is simply pressed or glued into the groove 61 in the scroll base. If the base is a fixed scroll base, then the involute is placed in the base so that the end surface 67 is received in the base groove 61. On the other hand, if the base is an orbiting scroll base, then the involute is placed in the base so that the end surface 69 is received in the base groove 61. An elastomeric seal (shown in FIG. 1) is then placed in the exposed groove of the involute.

Production of scroll assemblies according to this method reduces the number of machining passes from six to eight passes to just a single pass. As can be appreciated, this drastically reduces the manufacturing time and cost of the scroll assemblies.

As various changes could be made in the above constructions without departing from the scope of the invention, it is intended that all matter contained in the above description or shown in the accompanying drawings shall be interpreted as illustrative and not in a limiting sense.

What is claimed is:

1. An idler shaft for use in a scroll compressor; the idler shaft having a first part and a second part; the first part being a one-piece unitary part including a base having a first surface and a second surface and a stem extending from the base first surface, the first part having an axis of symmetry; the first part including a bore in the base second surface offset from the axis of symmetry; the second part being secured to the first part and including a shaft which is received in the bore of the first part base; the second part having an axis of symmetry; whereby, the axis of symmetry of the first part is offset from the axis of symmetry of the second part.

2. The idler shaft of claim 1 wherein the bore in first part base is a threaded bore; the second part including a base, a stem extending from the second part base, and a bore extending through the center of the base and the stem of the second part; said shaft having a threaded end; said shaft extending through said second part bore to be threaded into said bore of said first part.

3. A scroll plate for use in a scroll compressor, the scroll plate including a base and an involute extending generally perpendicularly from said base, the involute having a groove at an upper end and an elastomeric seal in said groove; said scroll plate being formed by the process of:

forming a scroll base plate;

forming an involute groove in the base;

forming an involute to net shape, the involute having a wall, and opposed end surfaces on said wall;

forming grooves in both of said opposed end surfaces of said involute such that said involute can be used in forming both a fixed scroll plate and an orbiting scroll plate;

fixing said involute to said base plate, one of said end surfaces of said involute being received in said base plate groove, the other of said end surfaces of said involute defining said upper end of said involute; and inserting said elastomeric seal in said upper end groove.

4. The scroll plate of claim 3 wherein the involute groove in the base is machined in the base.

5. The scroll plate of claim 3 wherein said involute is formed by one of molding and die casting.

6. A scroll compressor including a fixed scroll plate, an orbiting scroll plate, and an idler shaft extending between and connecting said scroll plates;

said idler shaft having a first part and a second part; the first part being a one-piece unitary part including a base, a stem, and a shaft extending up from the stem, the first part having a axis of symmetry; the second part being secured to the first part and including a shaft; the second part having an axis of symmetry; the first and second parts being secured together such that the axis of symmetry of the first part is offset from the axis of symmetry of the second part; and each said scroll plate being made from a two piece assembly; the two piece assembly including a scroll base plate and an involute; the involute for said orbiting scroll plate and said fixed scroll plate being identical; said scroll plates being formed by the process of forming the scroll base plate; forming an involute groove in the base; forming an involute to net shape, the involute having a wall, and opposed end surfaces on said wall; forming grooves in said opposed end surfaces of said involute; fixing said involute to said base plate, one of said end surfaces of said involute being received in said base plate groove, the other of said end surfaces of said involute defining said upper end of said involute; and inserting an elastomeric seal in said upper end groove.

7. An idler shaft for use in a scroll compressor; the idler shaft consisting essentially a first part and a second part fixed directly to the first part; the first part and second parts being substantially identical and being a one-piece unitary parts; said first and second parts each including a base and a stem from the approximate center of the base; said first and second parts each having an axis of symmetry; the second part being base being fixed to the first part base such that the second part shaft extends away from the first part shaft and the axis of symmetry of the first part is offset from the axis of symmetry of the second part.

* * * * *